United States Patent [19]

Fischer et al.

[11] Patent Number: 4,991,829

[45] Date of Patent: Feb. 12, 1991

[54] METHOD FOR CONTROLLING TWO INTERRELATED TRANSPORT MEANS AND MACHINE THUS CONTROLLED, ESPECIALLY A PERSONAL BANKING MACHINE

[75] Inventors: Ludwig Fischer, Herrenberg; Manfred Haas, Waldenbuch; Hermann Pape, Gäufelden, all of Fed. Rep. of Germany

[73] Assignee: International Business Machines Corporation, Armonk, N.Y.

[21] Appl. No.: 402,315

[22] Filed: Sep. 5, 1989

[30] Foreign Application Priority Data

Sep. 7, 1988 [EP] European Pat. Off. ..... 88114602.1

[51] Int. Cl.[5] ..... B65H 5/26

[52] U.S. Cl. ..... 271/9; 271/270; 271/199; 271/202; 221/1; 221/15; 221/93; 270/58; 235/379; 902/15; 902/17

[58] Field of Search ..... 221/1, 9, 10, 13, 15, 221/93, 112, 123, 124, 126, 133; 271/9, 270, 199, 202, 265; 270/58; 235/379; 902/15, 17; 414/789.6, 789.9, 790.7

[56] References Cited

U.S. PATENT DOCUMENTS 3,595,561 7/1971 Leblant ..... 271/9

FOREIGN PATENT DOCUMENTS 0036266 10/1984 European Pat. Off. .

2046975 11/1980 United Kingdom ..... 271/9

2141407A 12/1984 United Kingdom .

*Primary Examiner*—David H. Bollinger

*Attorney, Agent, or Firm*—J. R. Hanway

[57] ABSTRACT

A method and personal banking machine is described by which two items such as cash and statement can be issued simultaneously through one and the same gate. The optimum point in time is determined and adaptively controlled by which the front edge of statement touches the bundle of bank notes during issuing movement of the bank notes. Then both, bank notes and statement, are moved together to their respective end positions. The method and the machine starts the statement transport after a certain monitored delay time (DELTA-STATEMENT). By calculating out of the time difference between the point in time at which the bank notes reach the end position and the statement reaches its end position, a new time delay (DELTA-STATEMENT) is calculated for the next combined cash and statement issue operation. The method provides for the simultaneous issuance of bank notes and a statement through a common exit gate.

10 Claims, 4 Drawing Sheets

METHOD FOR CONTROLLING TWO INTERRELATED TRANSPORT MEANS AND MACHINE THUS CONTROLLED, ESPECIALLY A PERSONAL BANKING MACHINE

FIELD OF THE INVENTION

The present invention relates to a method for determining and adaptively controlling the optimum moment in time to start a second transport means after the start of a first transport means, both interrelated transport means having different velocities, so that the front edges of both transported items reach a certain end position, after a certain amount of common way in the transport path, whereby said transported items and the paths of their transporting means merge under a certain angle, said angle being preferably up to 90°. The invention furthermore relates to a personal banking machine controlled by the inventive method.

DESCRIPTION OF BACKGROUND ART

European Patent Specification No. 0 036 266 B1 describes a bank note dispensing machine with a delivery device for the receipt for the bank notes dispensed. Bank notes are transported from a first source to a delivery conveyor by a first transport means. The printed receipt, documenting the delivery of the dispensed bank notes, is transported from the printer through a second transport path and delivered then to the back of the already stacked bundle of bank notes on the very same conveyor. If both, bank notes and receipt are collected on the conveyor, both are transported through an exit slot of the machine. There the consumer can grasp the bank notes together with the printed receipt.

In this known bank note dispensing machine the bank notes and the receipt exit the machine through one and the same slot simultaneously. Nevertheless they are bundled inside the machine in such a way, that the collection of money and receipt has to be performed outside of a safe. A safe very often is required for keeping the money, and after the money has been collected in the correct and needed amount then this bundle of bank notes is exited through a slot from the safe. Such a delivery method of the money out of a safeguarded area is not possible with the delivery systems of the present invention, particularly the IBM 4731.

In the UK Patent Application No. GB 2 141 407 A, a cash dispensing machine is described in which one or more bank note stores and one receipt store are provided in a stack. The lower most, or in other words the transport path in the upstream position, is provided for the receipt store. During issuing the bank notes from the different stores to the exit gate, a receipt is printed and, after the last issued bank note, delivered into the very same transport path to exit the same gate. A simultaneous exiting of receipt and bank notes at the slot or the exit gate of the banking terminal is not possible with this machine.

The IBM 4731 Personal Banking Machine provides the possibility to issue bank notes, to issue statements and to issue statements together with bank notes. The bank notes are kept in cartridges within a safe and within the safe arranged in the bundle to be issued to the consumer. Only if the bundle contains the correct number of bank notes are they provided on a conveyor to be issued through a slot within the safe. A printer is provided to print the receipt, to print one or more statements, to collect them and to issue them together with the bundle of bank notes simultaneously through one issue gate. There the consumer grasps the bundle of bank notes together with the statement. The bundle of bank notes is transported to the gate by the so-called front drive forming a first transport means. The statement or several statements also collected in a bundle are provided by a printer and collected at a statement issuing position. They are exited to the gate by a second transport means. Both transport means coincide at the issue gate in a certain angle of less than 90°. For more details reference is made to the IBM 4731 Personal Banking Machine General Information Manual Form Number GA 19-5346-1, especially chapter 2 as well as to IBM 4731 Personal Banking Machine Operators Guide Form Number GA 19-5357-1, chapter 2. Those manuals are incorporated here by references.

As already stated in the IBM 4731 Personal Banking Machine, statement or statements and bundle of bank notes are issued through a common gate or issuing slot and offered to the consumer. Statement and bundle of bank notes come together at the issue gate on transports from different independent units. So the statement is transported from the printer with a relatively low velocity of for example 70 mm/s. At the same time the bundle of bank notes is transported through the front drive, a pair of belts clamp the bundle in between them, and transport the bundle of bank notes with a relatively high velocity of about 300 mm/s to the issuing slot.

The bundle of bank notes with the statement or the statements, are brought together and because of the different velocities of the items, the following problems are caused:

The fast moving bundle of bank notes pulls the statement too far. As a result, a predictable end position of the statement is not possible. This predictable end position of the statement is an absolute must. If the consumer forgets to take the statement or to take the bundle of bank notes after the elapse of a certain amount of time the statement and the bundle of bank notes will be retracted and deposited in different bins. The non-taking is sensed by the machine. If the statement is pulled too far out of the issuing gate by the moving bundle of bank notes the machine senses that the statement has been taken by the consumer. In reality the statement might still be within the gate. This leads to difficulties and malfunction of the machine.

There are different factors contributing to this problem. Those are that the velocity of the bundle of bank notes is essentially higher than that of the statement. Furthermore, the bundle of bank note and statement are not issued parallel to each other through the slot of the exit gate but they come together under a certain angle. Also, the slot of the exit gate is relatively narrow which means that the statement is pulled out of the slot of the exit gate by the bundle of bank notes beyond that which is desired. And, there is a relatively high coefficient of friction between the bank note and the statement, and furthermore, the statement is not kept within the printer or its delivering transport, but joined with the moving bank notes at a different velocity.

To avoid the bank note pulling out of the statement through the slot of the exit gate all of these factors would have to be improved. This would imply a redesign, and change of the construction, both imposing considerable cost and time efforts.

One possible solution probably would be to delay the transport of the statement to the slot of the issuing gate so that it is issued through the slot after the bundle of bank notes already has been issued. But in reality, it is impossible to push the thin statement or the thinner bundle of statements through the slot later, since the slot is very narrow and the bundle of bank notes fans out and thus gets thicker outside of the issuing gate, thus the slot is clogged up. Such a method of operating would lead to a blocking and jamming of the issue gate.

SUMMARY OF THE INVENTION

It is the object of the present invention to avoid the above mentioned drawbacks and to provide a method for determining the optimum moment in time at which two transported items should come together in frictional contact when they are issued by two transport means having different transport directions and having different transport velocities, so that both transported items reach a certain predetermined end position.

It is also an object of the present invention to have this method applied adaptively with every single case of issuing the items.

A further object of the present invention is to provide a personal banking machine with a control such that bank notes to be issued stemming from one source and statements stemming from a second source are issued through a common issuing gate simultaneously such that both reach a predetermined end position and no blocking of the gate or jam in the immediate vicinity of the gate or malfunction of the personal banking machine happens.

These objects and also further not mentioned objects and features are solved in an advantageous manner by the method claim 1 as well as by the apparatus claim 6 and its different appropriately associated subclaims. The method in accordance with the present invention provides in an advantageous manner the optimum point in time for bringing together the front edges of the statement with the bank note so that both on their final way through the gate reach their predetermined end position for optimum functioning of the banking machine. The method is adaptively working changes in machine parameters, so that a slowing down of motors or other variable factors do not detrimentally affect the functioning of the machine.

The adaptive controlling method in accordance with the present invention can preferably be implemented in microcode. This has the advantage that it can be used in different machines having different transport means, without the need to change the microcode. Therefore the inventive method can be used in a very flexible manner.

BRIEF DESCRIPTION OF THE DRAWINGS

The method of the present invention and a personal banking machine using this method will be described in further details in connection with a preferred embodiment of the invention as shown in.

DESCRIPTION OF THE PREFERRED EMBODIMENT

Figure 1:
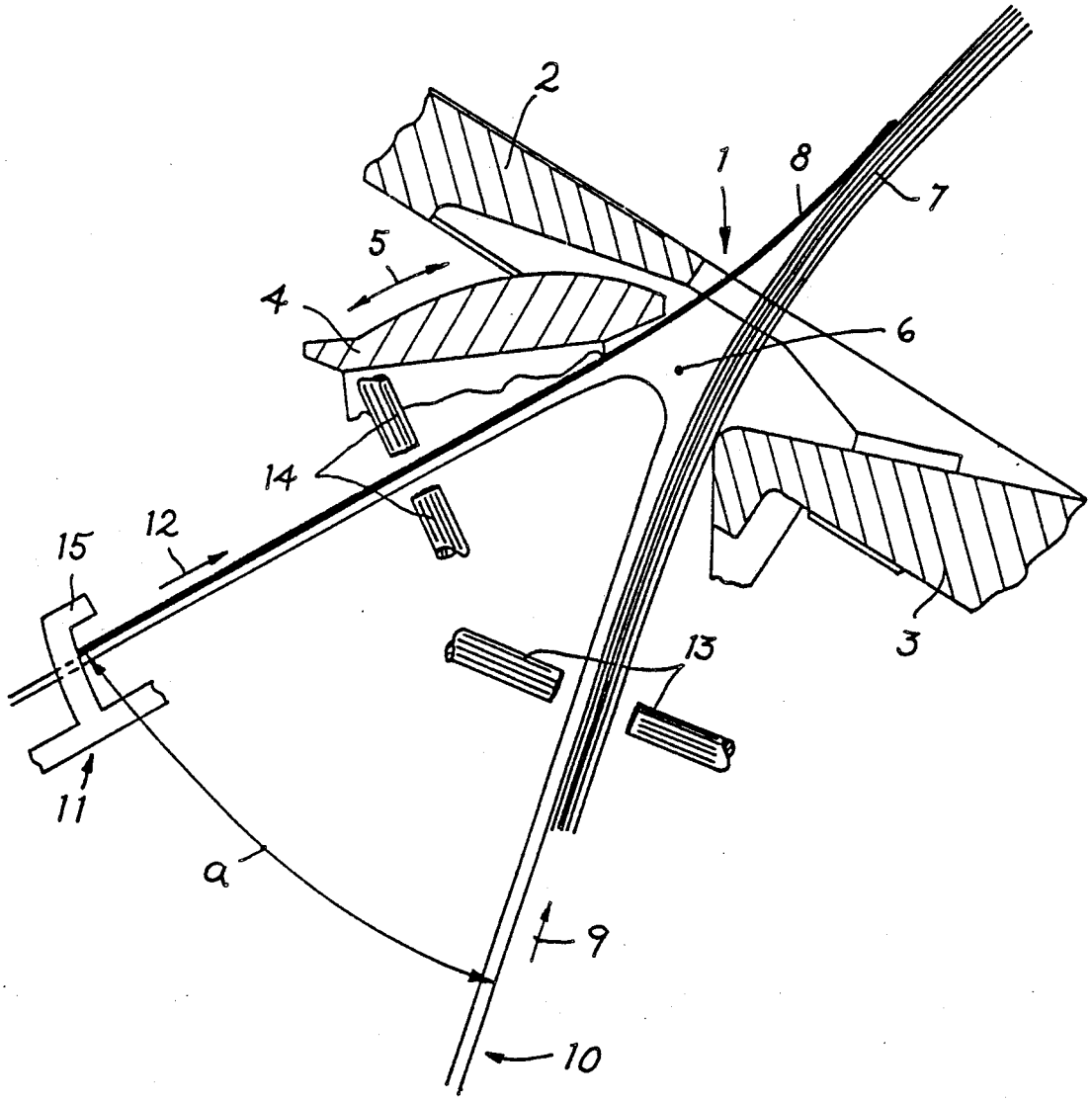
FIG. 1 a schematic view of an issue gate together with a bundle of bank notes and a statement coming together from different transport paths under an angle $\alpha$.

With reference to FIG. 1 schematically the area behind the issue gate 1 is shown. Issue gate 1 is essentially made up by two wall parts 2 and 3 above and below a moveable flap 4. Flap 4 is moveable in direction of double arrow 5 either to the open position as shown in FIG. 1 or to the closed position when Flap 4 is turned to the right in FIG. 1 and closes issue slot 6. Issue slot 6 essentially is formed by the right end part of flap 4 and wall part 2 on the left side, seen in FIG. 1, and on the left hand side of wall part 3 on the right side of slot 6. Within slot 6 there is shown a bundle 7 of bank notes, hereinafter referred to as cash 7. Furthermore, in the slot 6 there is shown statement 8. It might be, that there are several statements, but in the following it is only talked about statement in the singular and nominated as 8. Cash 7 is transported in accordance to arrow g by a first transport means 10, called the front drive which is only indicated schematically in FIG. 1. Statement 8 is transported by a second transport means 11 in the direction of arrow 12 toward slot 6 of issue gate 1. The main directions, indicated by arrows 9 and 12 of the respective first transport means 10 and second transport means 11 are inclined to each other by an angle $\alpha$. This angle $\alpha$ is less than 90°. Those transport paths converge within the area of slot 6 of issue gate 1. Within slot 6 statement 8 and cash 7 touch each other and change in a curved manner their formerly straight direction of movement. In the transport path of first transport means 10 there is provided a sensor 13 which is used to sense the end position and the presence of cash 7 in the exit position. Furthermore, in the transport path of second transport means 11 there is provided a sensor 14 for sensing the predetermined end position of statement 8 within exit slot 6 of issue gate 1.

Figure 2:
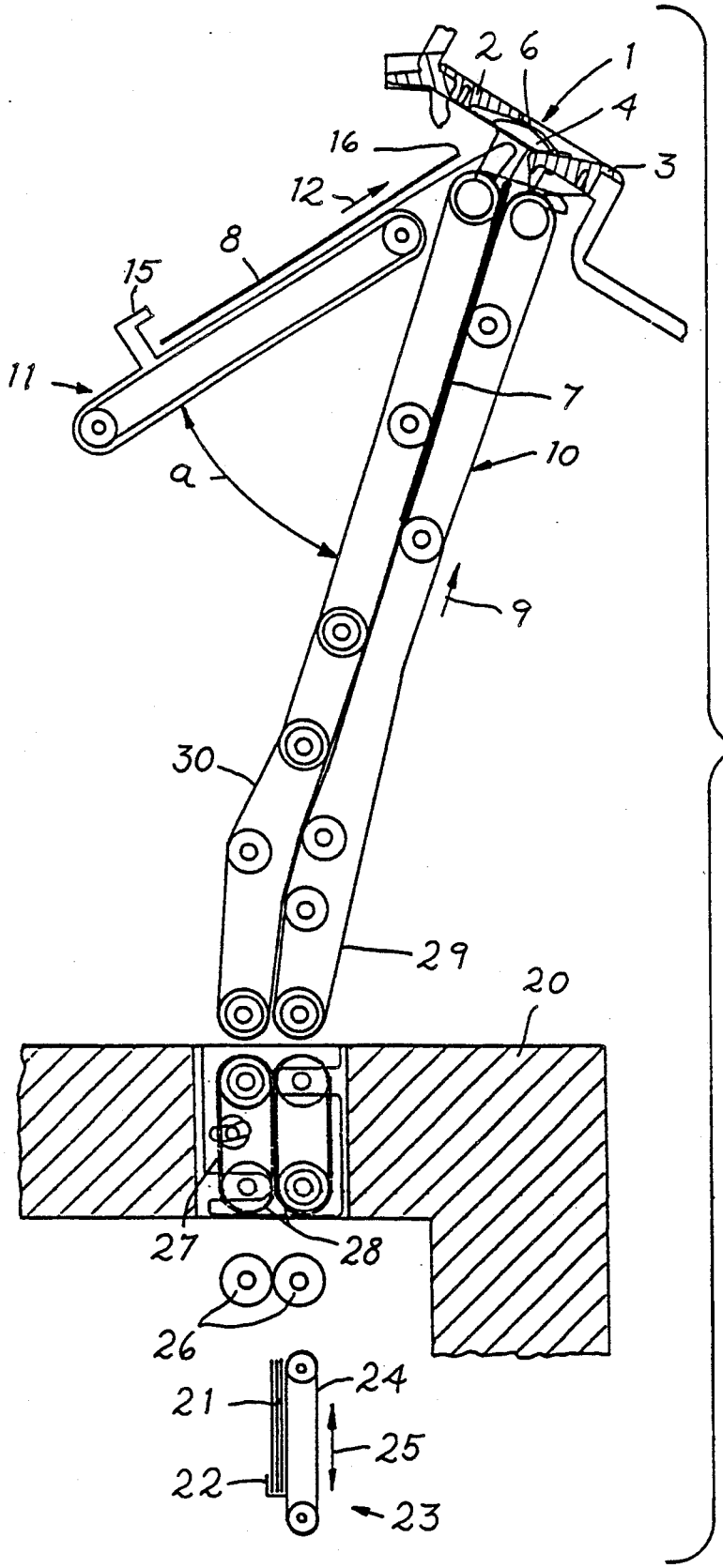
FIG. 2 a schematic view of two transport paths coming together at a common issue gate and, the safe in which money is bundled and then transported through a front drive to the issue gate.

FIG. 2 shows in addition to the gate area as shown in FIG. 1, further details schematically of the cash issuing from the first transport means 10 as well as the cash source. The cash is kept within a safe 20. By means not shown in further details it is collected as a bundle 21 behind a hook-like member 22 of a conveyor 23. Conveyor 23 moves the hook-like member 22 which is attached to belt 24 up and down in accordance to double arrow 25. If hook-like member 22 with bundle 21 is in its upper position of conveyor 23, the bundle is caught by two transport rollers 26 and furthermore transported to a transport device 27. This transport device 27 formed by belts 28 transports the bundle 21 further up and delivers it to first transport means 10. First transport means 10 is formed essentially by two belts 29 and 30 which are guided over several rollers and guide the bundle 21 between themselves up to slot 6 of issue gate 1 in accordance with arrow 9.

Shown in more detail in FIG. 2 is second transport means 11 that transports statement 8 to slot 6 of issue gate 1. There a statement 8 rests against a hook-like member 15. If second transport means 11 turns clockwise as shown in FIG. 2, then statement 11 resting against hook-like member 15 is transported in direction of arrow 12 toward slot 6 of issue gate 1.

As seen in FIG. 2, the way bundle 21 of cash 7 has to be transported is much longer than statement 8 has to be transported from the not shown printer 2, both to the slot 6. Depending on different machine design and different wall thickness of safe 20, this path length varies. Therefore, the velocity $V_C$ of front drive 10 forming the first transport means, and also for transport means 27 and the velocity of conveyor 23, is chosen as a higher velocity than for velocity $V_S$ of the statement. The actual value in a practical example is for $V_C$ 300 mm/S and for $V_S$ 70 mm/S. For an optimum issue of both cash 7 and statement 8 it has been found that front edge 16 of statement 8 has to join cash 7 at a moment in time at which first transport means 10 is still moving cash 7 upward in direction of arrow 9 toward the respective end position of cash 7. Then both transport means 10 and 11, having different Velocities $V_C$ and $V_S$ move together. Both transport means 10 and 11 are then stopped at the same or different moments in time, depending upon the different end positions of those transport means.

Figure 3:
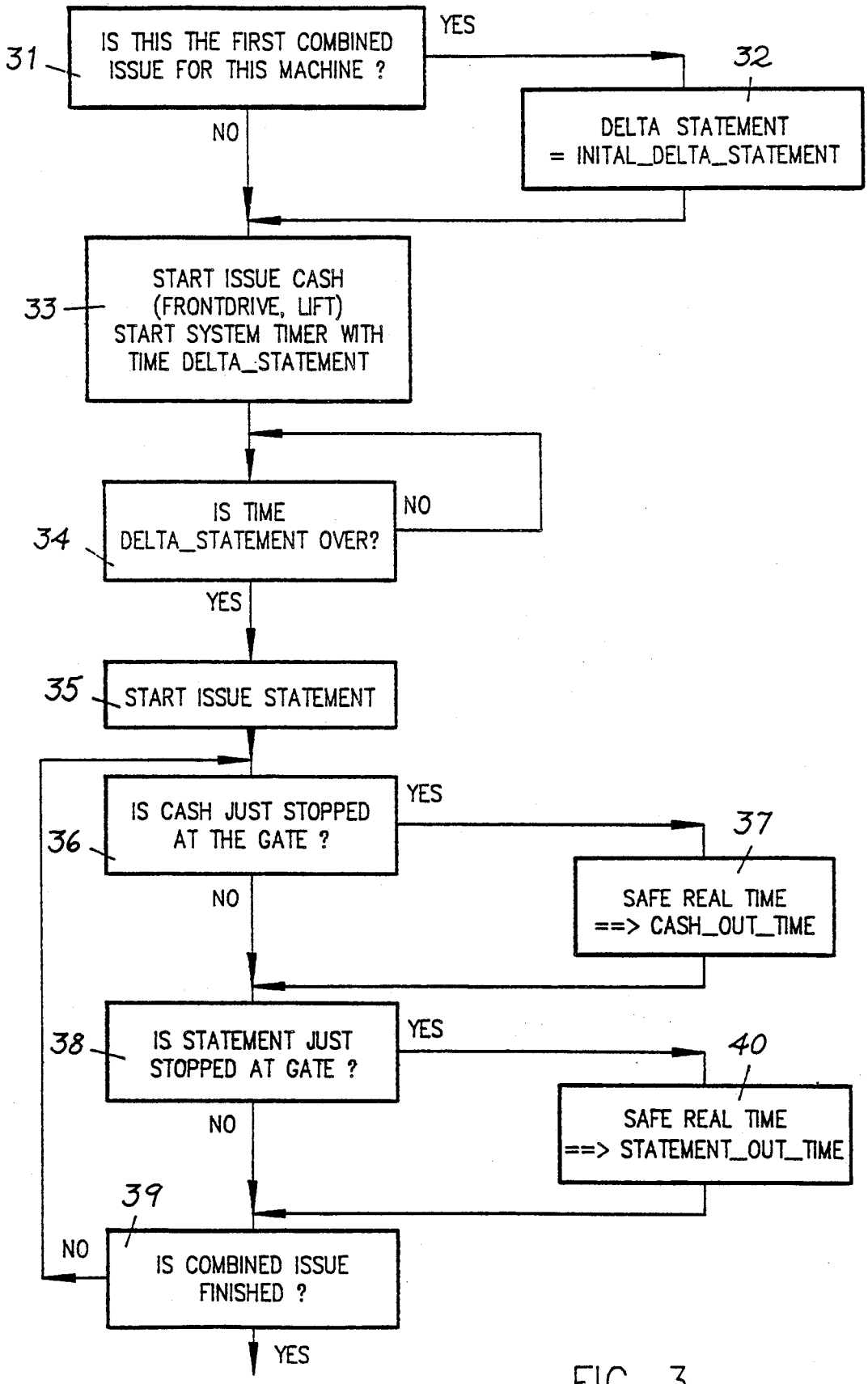
FIG. 3 a flowchart showing the method in accordance with the present invention.
Figure 4:
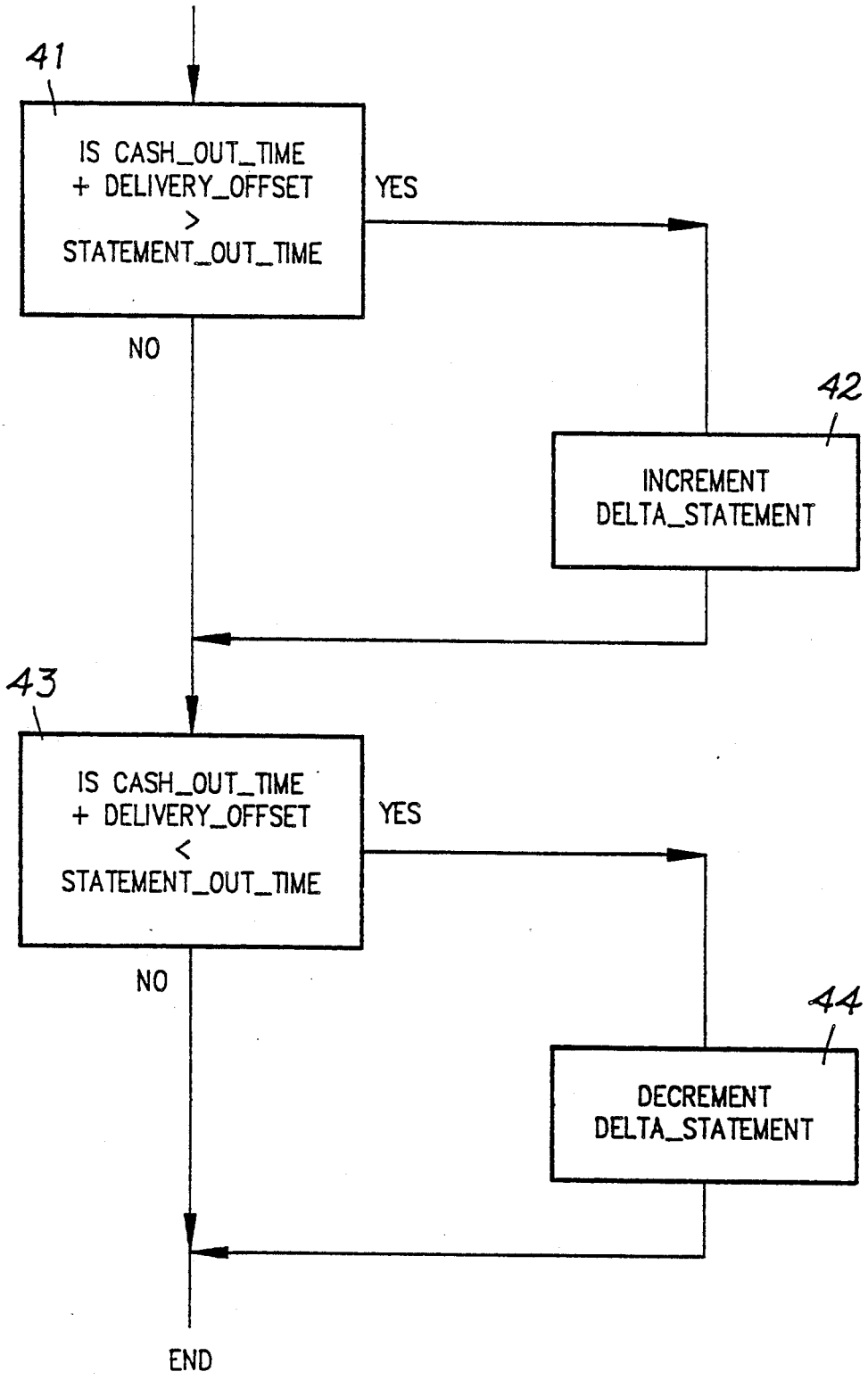
FIG. 4 a flowchart showing the method for calculating the DELTA-STATEMENT for the next combined issue.

In connection with the flowchart as shown in FIGS. 3 and 4, and the adaptive control method of the invention will be described. The optimum moment in time at which statement 8 and cash 7 touch each other in slot 6 of issue gate 1 is reached, if cash 7 helps to pull statement 8 out through the slot. On the other hand, statement 8 is not allowed to be pulled out over its predetermined end position. That means that upon touching of cash 7 and statement 8 the way left to be travelled for the statement in its end position, is not allowed to be shorter than the way left for the cash 7 to be transported in its respective end position. This method also considers the different transport velocities $V_C$ and $V_S$, the different lengths of both paths, the lengths of the transported items.

The adaptive control is characterized by starting the first drive means 10, i.e. front drive and conveyor 23 together with transport means 27 first. i.e. starting the transport means having the longer transport time first. Then the second transport means 11, having the shorter transport time to the exit slot 1, is started after a predetermined delay time DELTA-STATEMENT. The time at which cash 7 has reached its end position and the time at which the statement reaches its respective end position is monitored. Out of the time differences between the times at which cash 7 and statement 8 reach their respective end positions a new predetermined delay time DELTA-STATEMENT is calculated. This new DELTA-STATEMENT is then used as the predetermined delay time for the next combined issue of statement 8 and cash 7. This routine is repeated with every transport action using both transport means.

The program written as microcode uses the following main routines as shown in FIG. 3. In block 31 the program asks if this is the first combined issue for this machine. If this is the case. i.e. that the question is answered with yes, a default value for the DELTA-STATEMENT is fetched for using it for the INITIAL-DELTA-STATEMENT. From block 32 then the program goes to block 33. On the other hand if in the question of block 31 the answer was no, i.e. that it was not the first combined issue for this machine, the program also goes to block 33. In block 33 then the start for issuing cash is initiated. That means that conveyor 23 and front drive 10 (and also transport means 27) as shown in FIG. 2 are started. At the same time the system timer is started with time DELTA-STATEMENT. In the next block 34 it is asked if the time DELTA-STATEMENT is oVer. If this is not the case, the program goes back to the beginning of block 34 and runs through a loop. If block 34 says that the time DELTA-STATEMENT is over, program goes to block 35 and starts issuing the statement. That means that now the second transport means 11 transporting statement 8 out of the machine is initiated to move in direction of arrow 12. Next in block 36 it is asked, is cash 7 just stopped at the gate 1. If the answer is yes, the real time is saved forming the CASH-OUT-TIME. This is done in block 37. If that is done, from block 37 the program goes to block 38. If in block 36 the answer is no, i.e. that the cash 7 has not just stopped at the gate, the program goes directly to block 38 asking if the statement is just stopped at gate 1. If this is not the case, program goes to block 39 asking, if the combined issue is finished. If this is not the case, program goes back to the beginning of block 36. If on the other hand in block 38 the statement just stopped at the gate, and the question is answered with yes, the real time is saved forming the STATEMENT-OUT-TIME. This is done in accordance with block 40. From block 40 program goes back to the beginning of block 39. If in block 39 the answer to the question, is the combined issue finished, is positive, the program goes into the calculation routine of DELTA-STATEMENT for the next combined issue operation. This routine is shown in the flowchart of FIG. 4.

Block 41 is asking, is the CASH-OUT-TIME plus a DELIVERY-OFFSET greater than the STATEMENT-OUT-TIME as measured in block 40. If the answer is yes. DELTA-STATEMENT is incremented as shown in block 42. If this is not the case, in block 43 it is asked if the CASH-OUT-TIME plus the DELIVERY-OFFSET is smaller than the STATEMENT-OUT-TIME. If this is the case, then in block 44 a decrement of the DELTA-STATEMENT is performed. If the answer is no in block 43, both come to an end.

The newly calculated DELTA-STATEMENT is then used in the routine in accordance with FIG. 3, especially as stated in block 33. This adaptively corrected DELTA-STATEMENT is used for the start of the system timer in a new issue. Thus, the time delay, after which the second transport means 11 for transporting the statement to the gate, is thus monitored continuously.

By continuously monitoring, and if necessary recalculating, the value for DELTA-STATEMENT. as well as using it as default value in the beginning of a restart of the very same machine, an optimum moment in time is provided and safeguarded for the bringing together of statement 8 and cash 7.

As already described especially in connection with FIGS. 3 and 4, the above shown sequence is preferably always repeated when cash 7 and statement 8 are issued combined to the consumer.

In a practically used operating system the internal clock has 50 ms steps to increment the system clock. This time interval of 50 ms is called a time slice.

Thus the above mentioned variables mean the following:

DELTA-STATEMENT is the number of time slices the statement issue is started after the Start-Issue-Cash. This variable is stored in a non-volatile memory.

CASH-OUT-TIME is the time when the cash stops at the gate in its final end position.

STATEMENT-OUT-TIME is the time when the statement stops at the gate in its final end position.

DELIVERY-OFFSET is the time between when the cash 7 and the statement 8 stop and when the optimum meeting point is reached. This variable depends on the statement length's. In a practical example for the statement length's there are provided 101 mm and 106 mm. In this case the same value of 2 time slices is used since the difference in length's is only 5 mm.

INITIAL-DELTA-STATEMENT is a fixed value, that is used in the beginning for the very first cash and statement issuing operation. It is stored and can be replaced later on by the newly calculated DELTA-STATEMENT value.

As shown by the flowcharts, an implementation of the method in accordance with the present invention can be done by microcode. This has the advantage of great flexibility so that for example in both machines IBM 4731 and IBM 4732 which have different front drives (first transport means 10) the same code can be used. The only point is that the value for the DELTA-STATEMENT is different so that the start point for starting the statement transport 11 differs.

The method in accordance with the present invention and also the described personal banking machine including such an adaptive control provides many advantages. Specific machine parameters do not have to be determined in the beginning by measuring for each different machine, such as path length of bank notes and velocity of bank notes. Furthermore tolerances in production are considered by the adaptive control and thus an exact mechanical adjustment is not necessary. Also changes in wear and friction caused by aging are considered and thus no readjustment or changing of parts is necessary. A further big advantage is that for the drive of the different transport means cost reducing uncontrolled motors can be used.

It will also be apparent to those skilled in the art of control mechanisms for banking machines that various changes can be made in the format and content of the transport control mechanism herein described without departing from the spirit and scope of the invention.

What is claimed is:

1. A method of controlling two interrelated transport means having different velocities, whereby said transported items and the paths of their transporting means merge at an angle less than 90 degrees, so that the front edges of both transported items reach a certain end position along a common transport path, comprising the steps of:

providing a fixed value time delay, designated INITIAL DELTA STATEMENT.

starting said first transport means having the longer transport time, starting said second transport means having the shorter transport time after a predetermined delay time designated INITIAL DELTA STATEMENT, monitoring the time, designated CASH OUT TIME, at which the items transported by said first transport means has reached its respective end position, monitoring the time, designated STATEMENT OUT TIME, at which the item transported by said second transport means has reached its respective end position, calculating the time difference between the time that said first and second transport means reaches their respective end positions, the resultant time difference being designated as DELTA STATEMENT, and adjusting the starting time of said second transport means by said DELTA STATEMENT.

2. A method as recited in claim 1, wherein the steps of starting said first transport means and adjusting the starting time of said second transport means by said DELTA STATEMENT is repeated with the actuation of said transport means.

3. A method as recited in claim 1, wherein said INITIAL DELTA STATEMENT is supplied at the start-up of a system from a default value determined by using said DELTA STATEMENT last calculated.

4. A method as recited in claim 3 wherein said default value is a stored value in a non-volatile memory.

5. A method as recited in claims 1, 2, 3, or 4 wherein the step of calculating DELTA STATEMENT further comprises calculating a time offset to correspond to an offset in the end positions of said transport items.

6. In a banking machine for issuing a first document, such as a bank note, and for simultaneously issuing a second document through a common exit gate, a transport control mechanism, comprising:

a first source for supplying a first document, a second source for supplying a second document, an exit path for receiving and merging said first and second documents and supplying them to said common exit gate, a first transport means for transporting a first document from said first source to said exit path, a second transport means for transporting a second document from said second source to said exit path said first and second transport path merging at said exit path at an angle of less than 90 degrees, a first monitoring means for marking the moment in time that said first document reaches a predetermined position in said exit path, a second monitoring means for marking the moment in time that said second document reaches a predetermined position in said exit path, means for calculating the difference in time for said first and second transport means to transport said first and second documents to said common exit gate by comparing said readings from said first and second monitoring devices to the time of travel of said documents from said respective sources to said common exit gate and thereby determine a delay time value representing the difference in time there between, and means to input said delay time value into said transport control mechanism for controlling the relative starting times of said first and second transport means to thereby simultaneously deliver said first and second document to said common exit gate.

7. In a banking machine control mechanism as recited in claim 6, wherein said means to input said delay time value into said transport control mechanism further comprises:

means for inputting said last calculated time delay value to the start times of said first and second transport means as a default value.

8. In a banking machine control mechanism as recited in claims 6 or 7, wherein said means to input said delay time value into said transport control mechanism further comprises:

means for using the last calculated time delay value to adjust the time delay value for a subsequent initiation of said first and second transports.

9. In a banking machine control mechanism as recited in claims 6 or 7, wherein said means to input said delay time value further comprises:

means to increment said time delay value to offset the points in time at which said documents merge in said exit path.

10. A time-adaptive mechanism suitable for use with a banking machine to issue first and second documents simultaneously through a common exit gate, said transport mechanism comprising:

first means for transporting the first document at a first speed;

second means for transporting the second document at a second speed and for merging the first and second documents together;

means for controlling the movement of said first and second transporting means, said controlling means delaying the movement of one of the transporting means, after the movement of the other transporting means, by a stored time delay value;

means for independently sensing the arrival times of the first and second documents at the exit gate;

means for determining any time difference between the sensed arrival times; and means for specifying a new stored time delay value which compensates for the determined time difference and which is calculated to make the documents arrive simultaneously at the exit gate during the next transporting operation.

* * * * *